US006190230B1

(12) United States Patent
Hou

(10) Patent No.: US 6,190,230 B1
(45) Date of Patent: Feb. 20, 2001

(54) WALKING AND ROCKING TOY DEVICE

(76) Inventor: Chin-Jung Hou, 58, Ma Yuan West St., Taichung (TW)

( * ) Notice: Under 35 U.S.C. 154(b), the term of this patent shall be extended for 0 days.

(21) Appl. No.: 09/480,707

(22) Filed: Jan. 7, 2000

(51) Int. Cl.[7] ..... A63H 11/14
(52) U.S. Cl. ..... 446/355; 446/268; 446/309
(58) Field of Search ..... 446/268, 297, 446/298, 302, 308, 309, 311, 313, 330, 347, 355, 376

(56) References Cited

U.S. PATENT DOCUMENTS

| | | | | |
|---|---|---|---|---|
| 3,583,098 | * | 6/1971 | Bear et al. | 446/355 |
| 3,596,398 | * | 8/1971 | Gardel et al. | 446/355 |
| 3,599,364 | * | 8/1971 | Garcia | 446/355 |
| 3,660,931 | * | 5/1972 | Gardel et al. | 446/355 |
| 3,704,543 | * | 12/1972 | Giroud | 446/355 |
| 4,095,367 | * | 6/1978 | Ogawa | 446/308 |
| 4,244,141 | * | 1/1981 | Douglas et al. | 446/355 |
| 4,349,987 | * | 9/1982 | Bart | 446/355 |
| 4,372,078 | * | 2/1983 | Spring | 446/355 |
| 4,579,542 | * | 4/1986 | Mayer et al. | 446/330 |
| 4,689,034 | * | 8/1987 | Dubois et al. | 446/309 |
| 4,878,874 | * | 11/1989 | Terzian | 446/355 |
| 5,224,896 | * | 7/1993 | Terzian | 446/355 |

* cited by examiner

*Primary Examiner*—Jacob K. Ackun
*Assistant Examiner*—Faye Francis

(57) ABSTRACT

A walking and rocking toy device has a base seat, a transmission mechanism, a hollow cylinder casing, and an annular cover. The hollow cylinder casing covers the base seat. The transmission mechanism is disposed between the base seat and the hollow cylinder casing. The hollow cylinder casing has a center portion and an annular recess receiving the annular cover. A micromotion switch device is disposed on the center portion of the hollow cylinder casing. A cell box is disposed on the base seat. A cell box cover is disposed on a bottom of the base seat to cover the cell box. A contact starting switch is disposed on a lateral of the cell box.

3 Claims, 8 Drawing Sheets

WALKING AND ROCKING TOY DEVICE

BACKGROUND OF THE INVENTION

The present invention relates to a walking and rocking toy device. More particularly, the present invention relates to a walking and rocking toy device which can rock and walk forward.

A conventional walking toy device has a very complex structure. It is not easy to assemble the conventional walking toy device. If an element is broken, the whole conventional walking toy device will become useless.

SUMMARY OF THE INVENTION

An object of the present invention is to provide a walking and rocking toy device which can rock and walk forward.

Accordingly, a walking and rocking toy device comprises a base seat, a transmission mechanism, a hollow cylinder casing, and an annular cover. The hollow cylinder casing covers the base seat. The transmission mechanism is disposed between the base seat and the hollow cylinder casing. The hollow cylinder casing has a center portion, a plurality of arc holes, a plurality of protruded blocks, and an annular recess receiving the annular cover. A micromotion switch device is disposed on the center portion of the hollow cylinder casing. The base seat has three columns inserted in the arc holes of the hollow cylinder casing and two pairs of pillars. Each of the columns has a threaded hole. Each of the pillars has a threaded aperture. A cell box is disposed on the base seat. A cell box cover is disposed on a bottom of the base seat to cover the cell box. A contact starting switch is disposed on a lateral of the cell box. The transmission mechanism comprises a first gear casing, a second gear casing engaging with the first gear casing, a motor and a gear set disposed between the first gear casing and the second gear casing, and two movable devices fastened on the first gear casing and the second gear casing. Each of the first gear casing and the second gear casing has an upper post having an upper groove, an arc arm, and two positioning plates fastened on the pillars. The gear set has a first gear coaxial with a belt pulley, a second gear coaxial with a first clutch gear and a second clutch gear, a third gear, a fourth gear, and a fifth gear. A shaft of the motor passes through the first gear casing. A belt surrounds the belt pulley and the shaft of the motor. The first gear engages with the second gear. The second gear engages with the fourth gear and the fifth gear. The fourth gear engages with the fifth gear. The first gear drives the second gear. The second gear drives the third gear. The third gear drives the first clutch gear and the second clutch gear. A coiled spring is disposed on the second clutch gear. The second clutch gear dirves the fourth gear and the fifth gear alternatively. A first shaft passes through the fourth gear. Two distal portions of the first shaft are fixed on the first gear casing and the second gear casing. The fifth gear drives a crown gear. A rotating shaft passes through the fifth gear and an eccentric wheel. Each of the movable devices has a walking plate having an oblong aperture receiving a second shaft and a circular hole receiving an eccentric shaft. The eccentric shaft has a square aperture receiving the first shaft. The second shaft passes through the fifth gear. A rocking device has a rocking bar, the rotating shaft, and the eccentric wheel. The eccentric wheel is disposed on a top portion of the first gear casing and a top portion of the second gear casing. A protruded rod is disposed on the eccentric wheel. The rocking bar has a round hole, an oblong hole, and a through hole. The round hole of the rocking bar receives the upper post. The oblong hole of the rocking bar receives the protruded rod. A round rod is disposed in the hollow cylinder casing to be inserted in the through hole of the rocking bar.

DETAILED DESCRIPTION OF THE INVENTION

Figure 1:
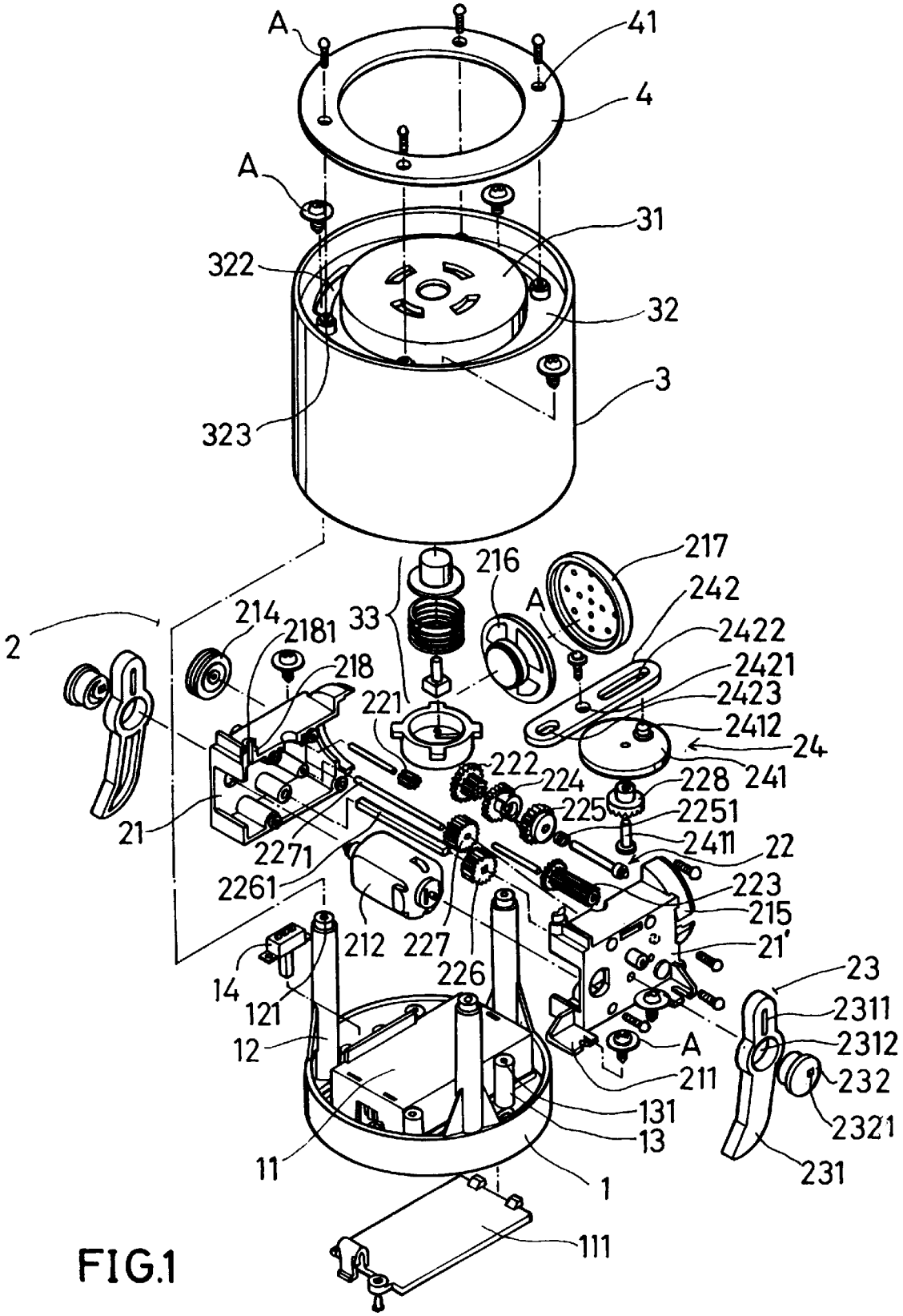
FIG. 1 is a perspective exploded view of a walking and rocking toy device of a preferred embodiment in accordance with the present invention.
Figure 2:
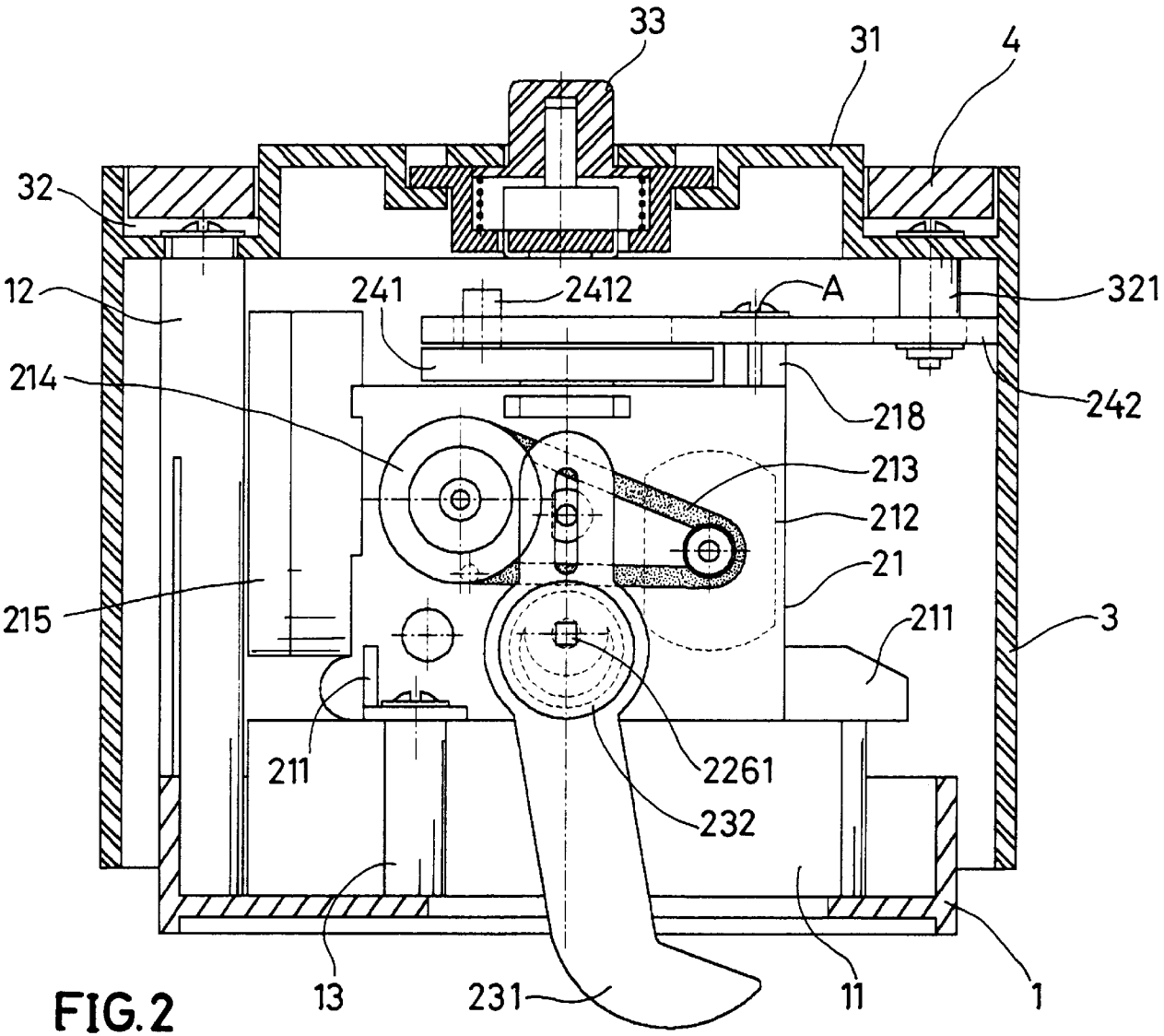
FIG. 2 is a sectional assembly view of a walking and rocking toy device of a preferred embodiment in accordance with the present invention.
Figure 3:
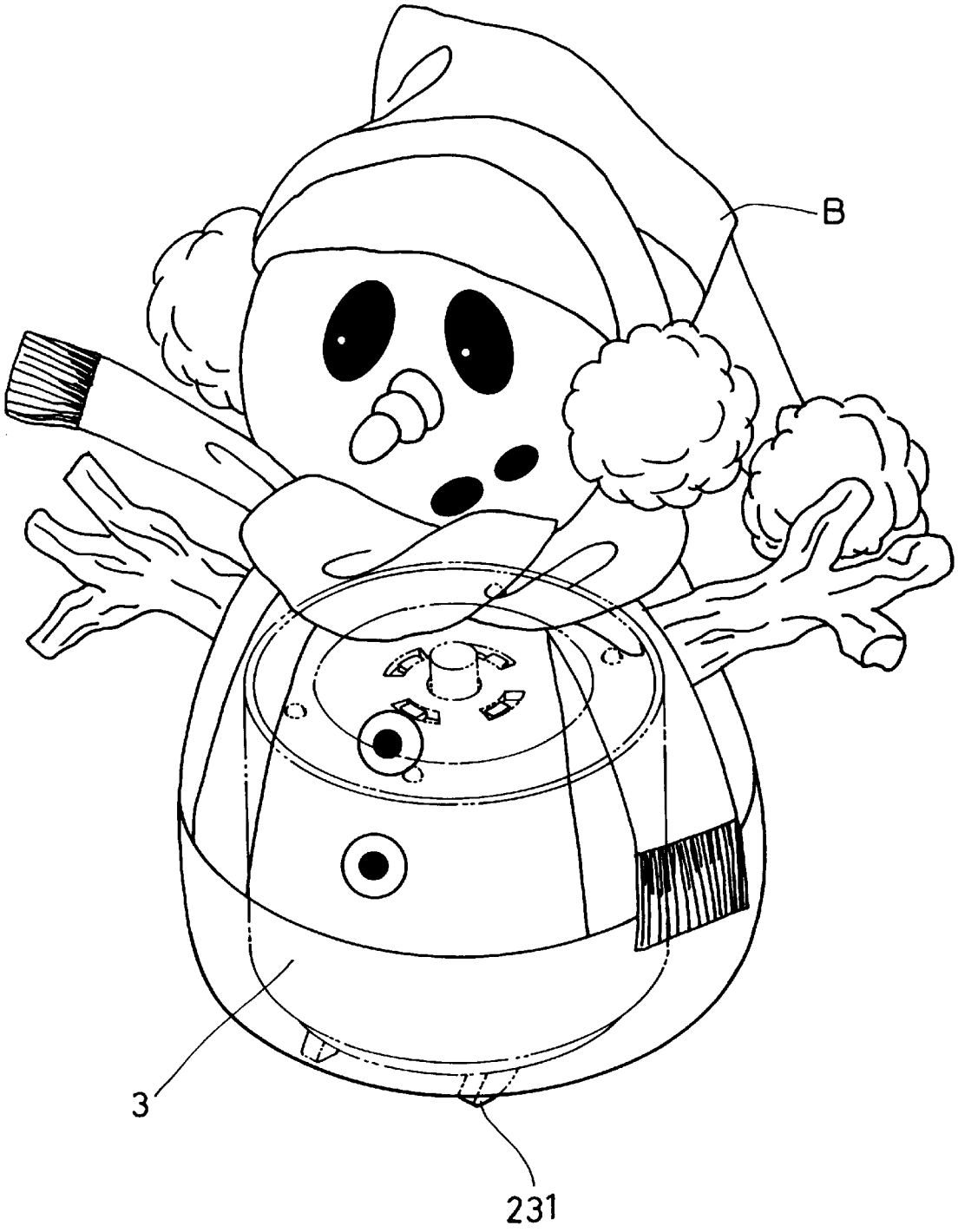
FIG. 3 is a perspective schematic view illustrating a doll enclosing a walking and rocking toy device of a preferred embodiment in accordance with the present invention.
Figure 4:
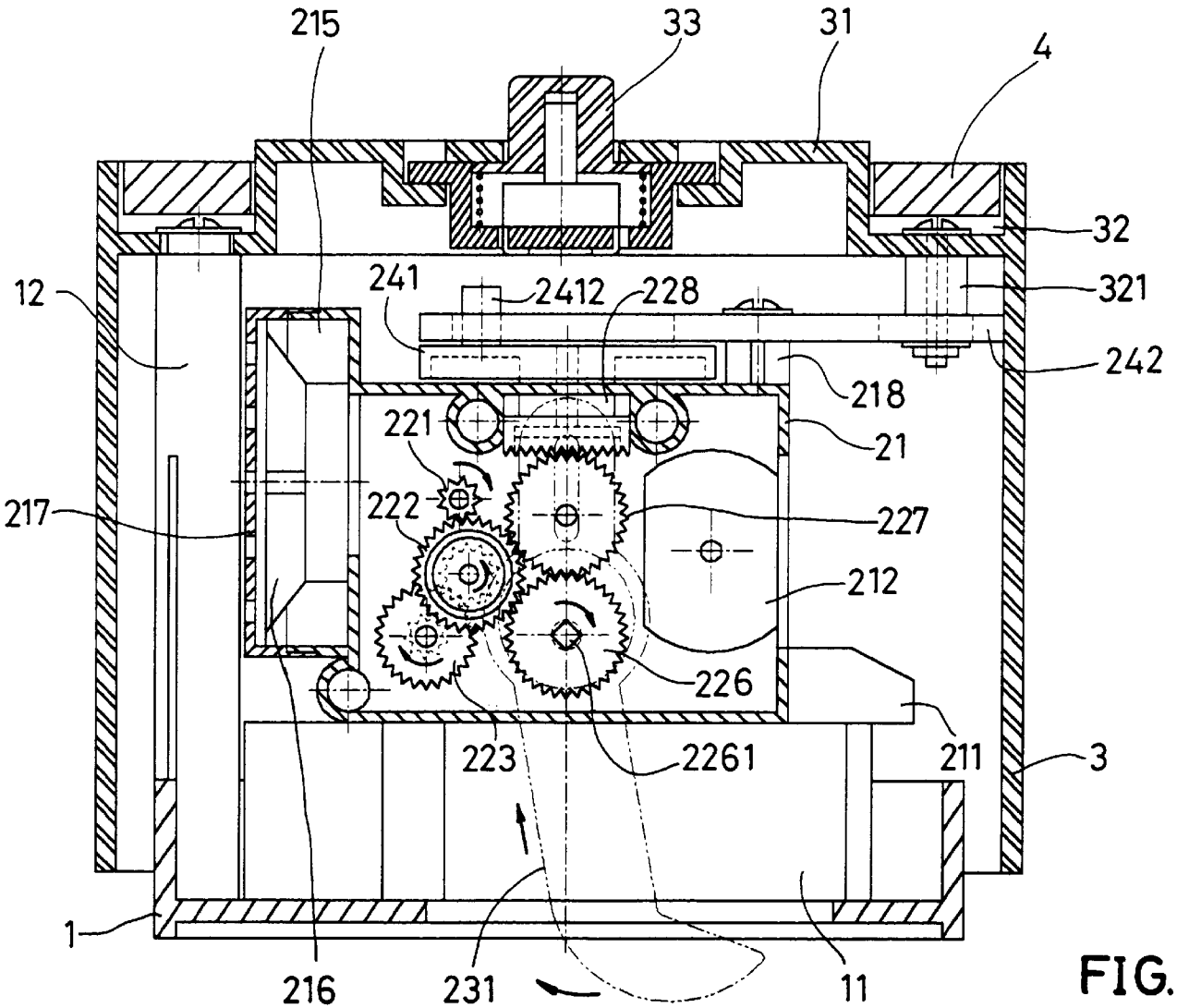
FIG. 4 is a sectional schematic view illustrating a forward operation of a walking and rocking toy device of a preferred embodiment in accordance with the present invention.
Figure 5:
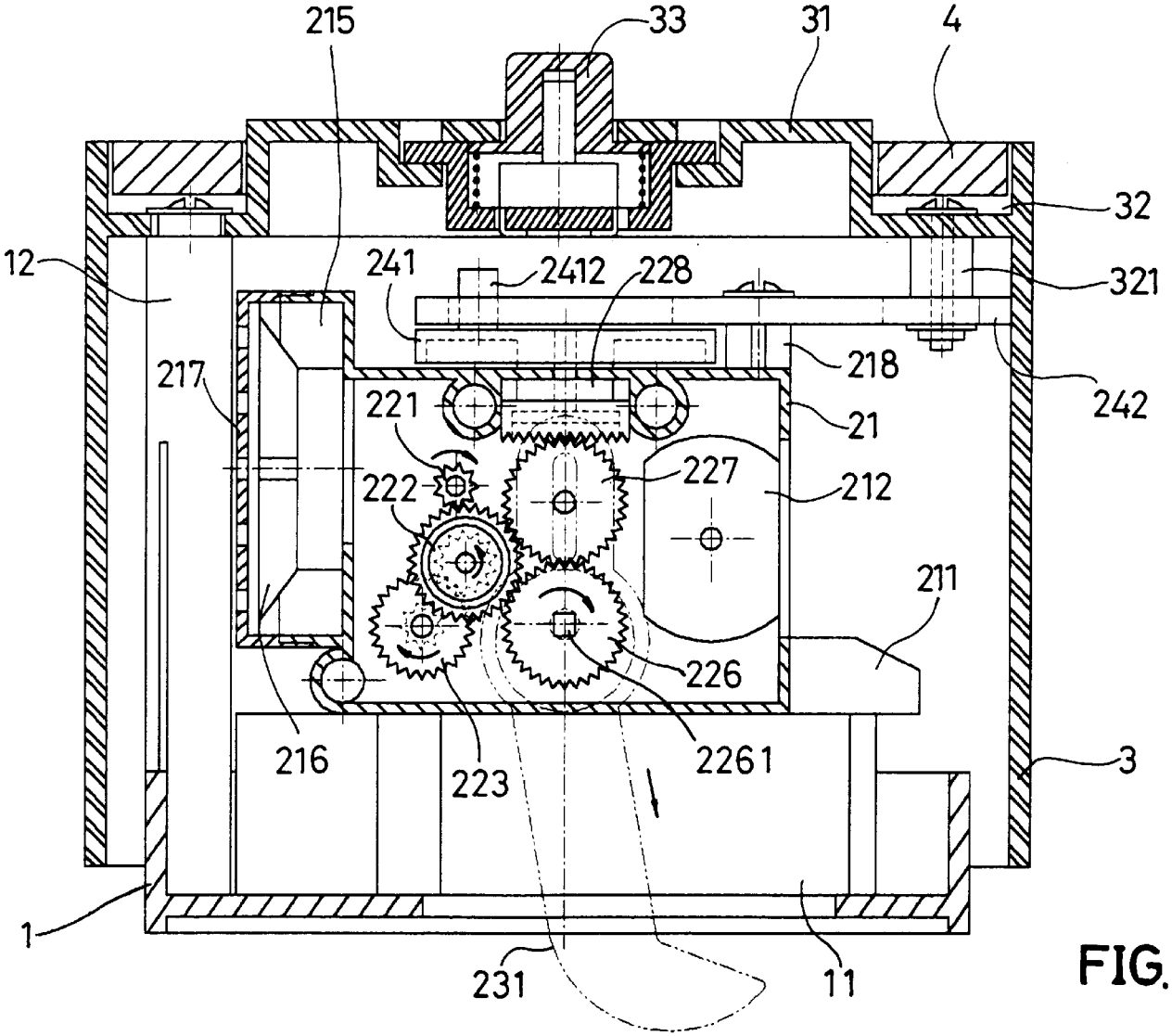
FIG. 5 is another sectional schematic view illustrating a forward operation of a walking and rocking toy device of a preferred embodiment in accordance with the present invention.
Figure 6:
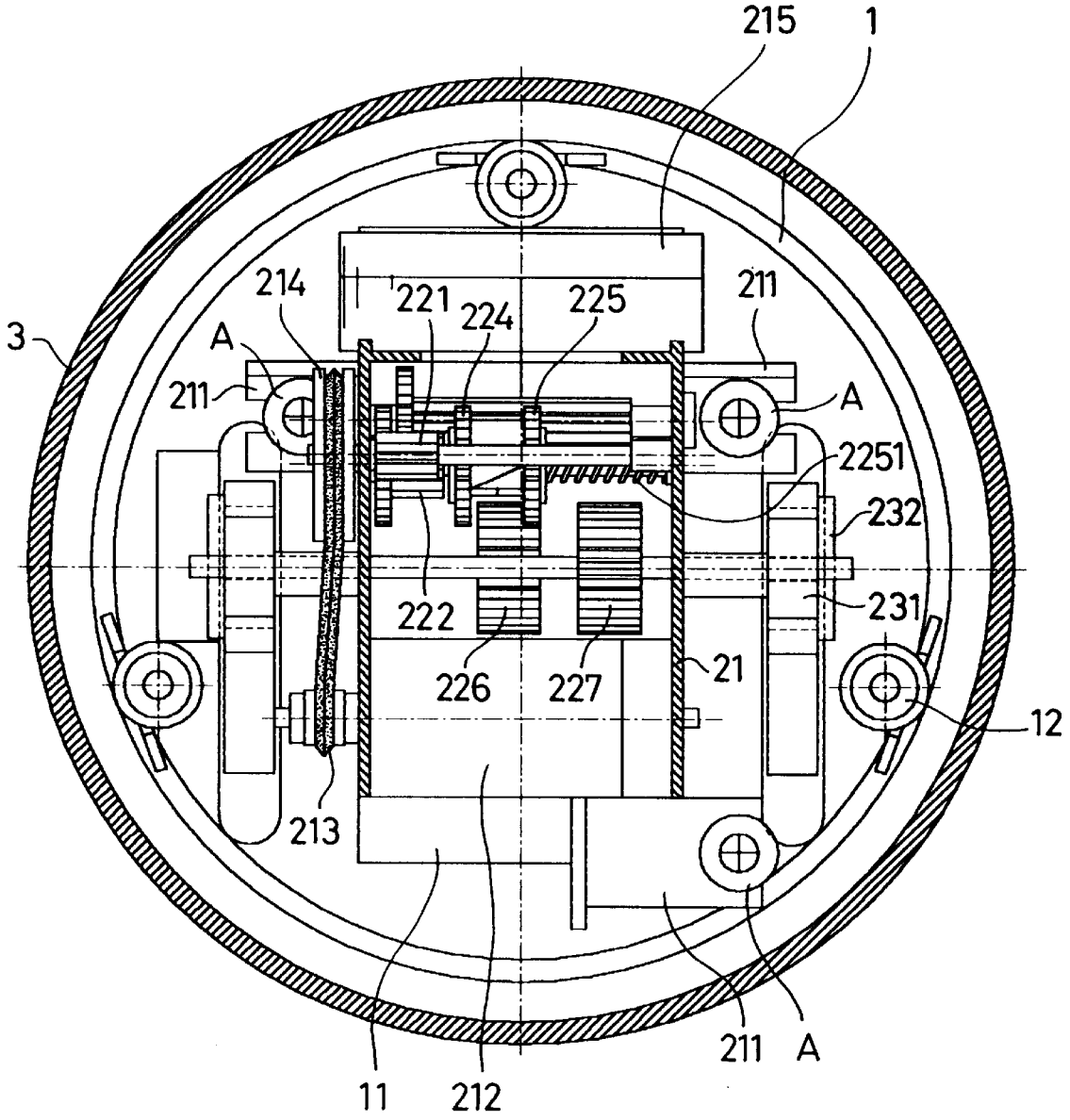
FIG. 6 is a sectional schematic view illustrating a position of a gear set while the gear set drives a movable device.
Figure 7:
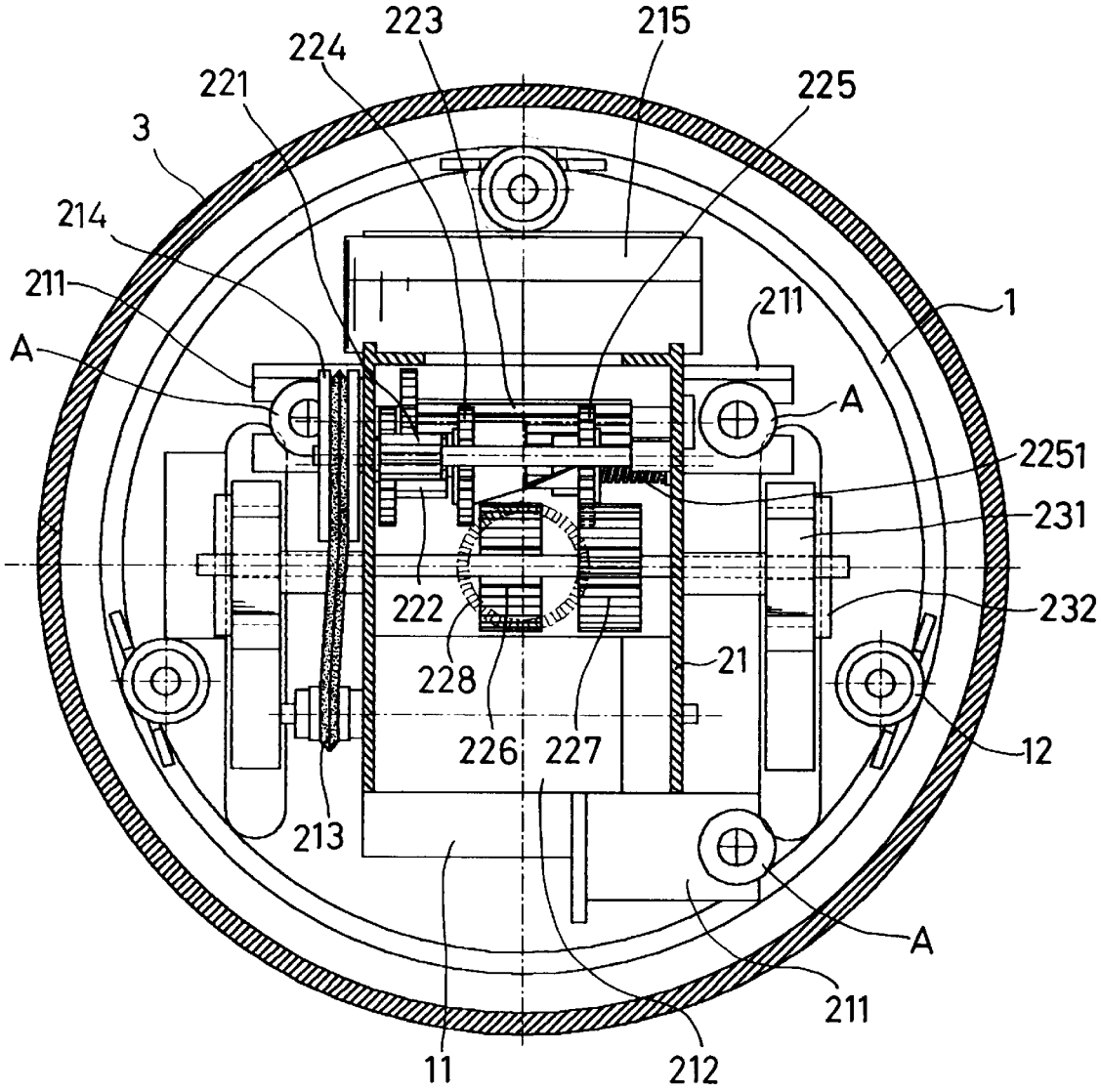
FIG. 7 is a sectional schematic view illustrating a position of a gear set while the gear set drives a rocking device.
Figure 8:
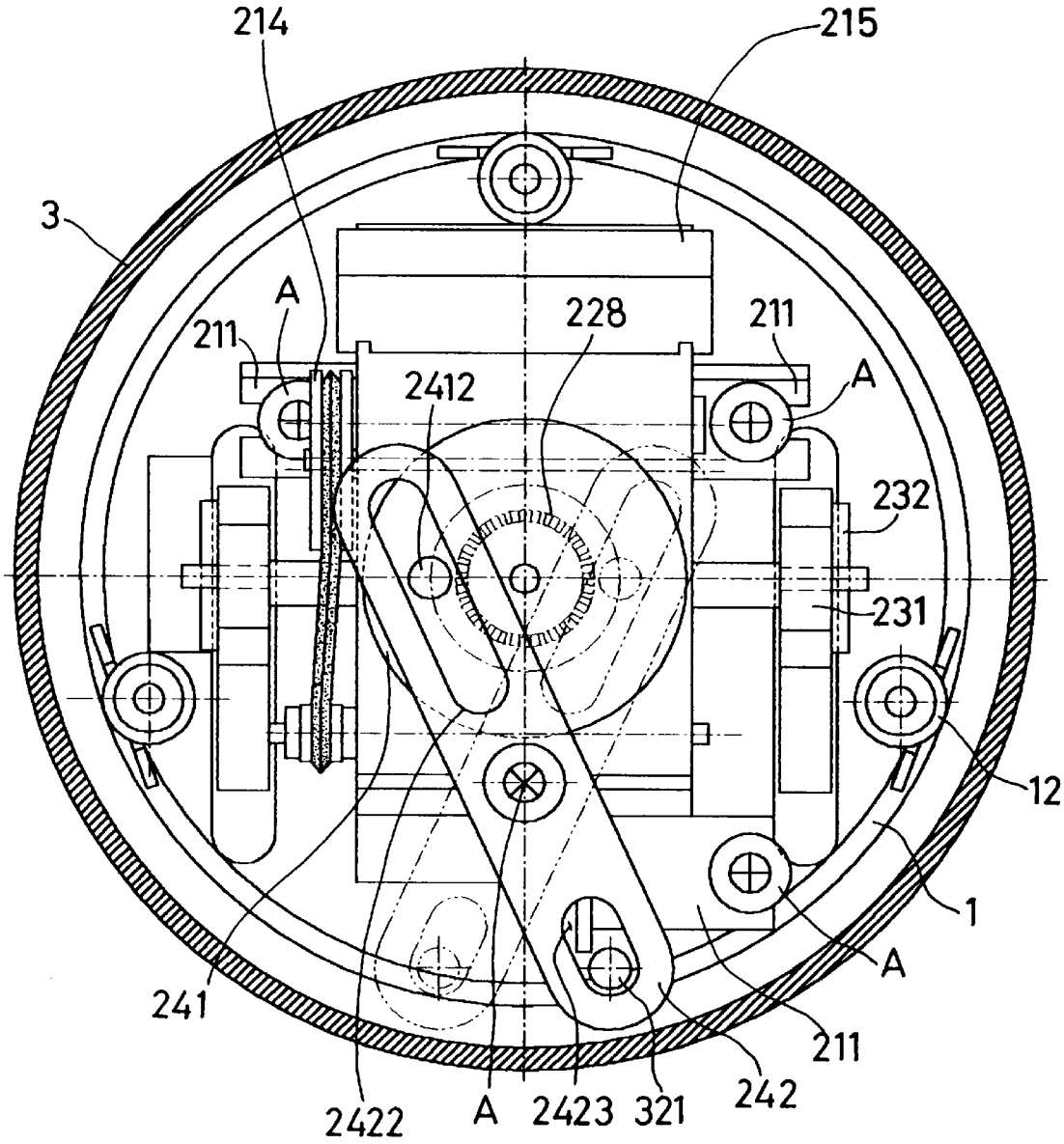
FIG. 8 is a schematic view illustrating an operation of a rocking bar of a preferred embodiment in accordance with the present invention.

Referring to FIGS. 1 to 8, a walking and rocking toy device comprises a base seat 1, a transmission mechanism 2, a hollow cylinder casing 3, and an annular cover 4.

The hollow cylinder casing 3 covers the base seat 1. The transmission mechanism 2 is disposed between the base seat 1 and the hollow cylinder casing 3.

The hollow cylinder casing 3 has a center portion 31, a plurality of arc holes 322, a plurality of protruded blocks 323, and an annular recess 32 receiving the annular cover 4.

A micromotion switch device 33 is disposed on the center portion 31 of the hollow cylinder casing 3.

The base seat 1 has three columns 12 inserted in the arc holes 322 of the hollow cylinder casing 3 and two pairs of pillars 13. Each of the columns 12 has a threaded hole 121. Each of the pillars 13 has a threaded aperture 131.

A cell box 11 is disposed on the base seat 1. A cell box cover 111 is disposed on a bottom of the base seat 1 to cover the cell box 11.

A contact starting switch 14 is disposed on a lateral of the cell box 11.

The transmission mechanism 2 comprises a first gear casing 21, a second gear casing 21' engaging with the first gear casing 21, a motor 212 and a gear set 22 disposed between the first gear casing 21 and the second gear casing 21', and two movable devices 23 fastened on the first gear casing 21 and the second gear casing 21'.

Each of the first gear casing 21 and the second gear casing 21' has an upper post 218 having an upper groove 2181, an arc arm 215 to clamp a horn 216, and two positioning plates 211 fastened on the pillars 13. A horn cover 217 encloses the horn 216.

The gear set 22 has a first gear 221 coaxial with a belt pulley 214, a second gear 222 coaxial with a first clutch gear 224 and a second clutch gear 225, a third gear 223, a fourth gear 226, and a fifth gear 227.

A shaft of the motor 212 passes through the first gear casing 21.

A belt 213 surrounds the belt pulley 214 and the shaft of the motor 212.

The first gear 221 engages with the second gear 222. The second gear 222 engages with the fourth gear 226 and the fifth gear 227. The fourth gear 226 engages with the fifth gear 227. The first gear 221 drives the second gear 222. The second gear 222 drives the third gear 223. The third gear 223 drives the first clutch gear 224 and the second clutch gear 225. A coiled spring 2251 is disposed on the second clutch gear 225. The second clutch gear 225 dirves the fourth gear 226 and the fifth gear 227 alternatively.

A first shaft 2261 passes through the fourth gear 226. Two distal portions of the first shaft 2261 are fixed on the first gear casing 21 and the second gear casing 21'.

The fifth gear 227 drives a crown gear 228. A rotating shaft 2411 passes through the fifth gear 227 and an eccentric wheel 241.

Each of the movable devices 23 has a walking plate 231 having an oblong aperture 2311 receiving a second shaft 2271 and a circular hole 2312 receiving an eccentric shaft 232. The eccentric shaft 232 has a square aperture 2321 receiving the first shaft 2261.

The second shaft 2271 passes through the fifth gear 227.

A rocking device 24 has a rocking bar 242, the rotating shaft 2411, and the eccentric wheel 241.

The eccentric wheel 241 is disposed on a top portion of the first gear casing 21 and a top portion of the second gear casing 21'. A protruded rod 2412 is disposed on the eccentric wheel 241.

The rocking bar 242 has a round hole 2421, an oblong hole 2422, and a through hole 2423.

The round hole 2421 of the rocking bar 242 receives the upper post 218.

The oblong hole 2422 of the rocking bar 242 receives the protruded rod 2412.

A round rod 3212 is disposed in the hollow cylinder casing 3 to be inserted in the through hole 2423 of the rocking bar 242.

Referring to FIG. 3 again, a doll B encloses the walking and rocking toy device.

Referring to FIGS. 4 to 6 again, the motor 212 drives the belt pulley 214 and the first gear 221. The first gear 221 drives the second gear 222. The second gear 222 drives the third gear 223. The third gear 223 drives the first clutch gear 224 and the second clutch gear 225. The second clutch gear 225 dirves the fourth gear 226. The first shaft 2261 drives the eccentric shaft 232 to rotate. The eccentric shaft 232 drives the walking plate 231 to move.

Since the rotating speed of the second clutch gear 225 is faster than the rotating speed of the first clutch gear 224, the second clutch gear 225 will be disengaged from the first clutch gear 224 until the second clutch gear 225 engages with the fifth gear 227. The fifth gear 227 drives the crown gear 228 and the eccentric wheel 241 to vibrate the rocking bar 242.

The present invention is not limited to the above embodiment but various modification thereof may be made. Furthermore, various changes in form and detail may be made without departing from the scope of the present invention.

I claim:

1. A walking and rocking toy device comprises:

a base seat, a transmission mechanism, a hollow cylinder casing, and an annular cover, the hollow cylinder casing covering the base seat, the transmission mechanism disposed between the base seat and the hollow cylinder casing, the hollow cylinder casing having a center portion, a plurality of arc holes, a plurality of protruded blocks, and an annular recess receiving the annular cover, a micromotion switch device disposed on the center portion of the hollow cylinder casing, the base seat having three columns inserted in the arc holes of the hollow cylinder casing and two pairs of pillars, each of the columns having a threaded hole, each of the pillars having a threaded aperture, a cell box disposed on the base seat, a cell box cover disposed on a bottom of the base seat to cover the cell box, a contact starting switch disposed on a lateral side of the cell box, the transmission mechanism comprising a first gear casing, a second gear casing engaging with the first gear casing, a motor and a gear set disposed between the first gear casing and the second gear casing, and two movable devices fastened on the first gear casing and the second gear casing, each of the first gear casing and the second gear casing having an upper post having an upper groove, an arc arm, and two positioning plates fastened on the pillars, the gear set having a first gear coaxial with a belt pulley, a second gear coaxial with a first clutch gear and a second clutch gear, a third gear, a fourth gear, and a fifth gear, a shaft of the motor passing through the first gear casing, a belt surrounding the belt pulley and the shaft of the motor, the first gear engaging with the second gear, the second gear engaging with the fourth gear and the fifth gear, the fourth gear engaging with the fifth gear, the first gear driving the second gear, the second gear driving the third gear, the third gear driving the first clutch gear and the second clutch gear, a coiled spring disposed on the second clutch gear, the second clutch gear dirving the fourth gear and the fifth gear alternatively, a first shaft passing through the fourth gear, two distal portions of the first shaft fixed on the first gear casing and the second gear casing, the fifth gear driving a crown gear, a rotating shaft passing through the fifth gear and an eccentric wheel, each of the movable devices having a walking plate having an oblong aperture receiving a second shaft and a circular hole receiving an eccentric shaft, the eccentric shaft having a square aperture receiving the first shaft, the second shaft passing through the fifth gear, a rocking device having a rocking bar, the rotating shaft, and the eccentric wheel, the eccentric wheel disposed on a top portion of the first gear casing and a top portion of the second gear casing, a protruded rod disposed on the eccentric wheel, the rocking bar having a round hole, an oblong hole, and a through hole, the round hole of the rocking bar receiving the upper post, the oblong hole of the rocking bar receiving the protruded rod, and a round rod disposed in the hollow cylinder casing to be inserted in the through hole of the rocking bar.

2. A walking and rocking toy device as claimed in claim 1, wherein a horn is disposed between the first gear casing and the second gear casing.

3. A walking and rocking toy device as claimed in claim 1, wherein a doll encloses the walking and rocking toy device.

* * * * *